United States Patent [19]

de Concini

[11] Patent Number: 4,717,079

[45] Date of Patent: Jan. 5, 1988

[54] FUEL METERING VALVE FOR INTERNAL COMBUSTION ENGINE SUPPLY DEVICE

[75] Inventor: Roberto de Concini, Zola Predosa, Italy

[73] Assignee: Weber S.p.A., Turin, Italy

[21] Appl. No.: 868,526

[22] Filed: May 30, 1986

[30] Foreign Application Priority Data

Jun. 11, 1985 [IT] Italy ..... 67542 A/85

[51] Int. Cl.[4] ..... F02M 51/06

[52] U.S. Cl. ..... 239/585; 251/129.15

[58] Field of Search ..... 239/585; 251/129.15

[56] References Cited

U.S. PATENT DOCUMENTS

| | | | |
|---|---|---|---|
| 4,230,273 | 10/1980 | Claxton et al. | 239/585 X |
| 4,274,598 | 6/1981 | Wilfert et al. | 239/585 |
| 4,613,081 | 9/1986 | Bauer | 239/585 |
| 4,625,919 | 12/1986 | Soma et al. | 239/585 |

FOREIGN PATENT DOCUMENTS

| | | | |
|---|---|---|---|
| 2034403 | 6/1980 | United Kingdom | 239/585 |

*Primary Examiner*—Andres Kashnikow
*Assistant Examiner*—Mary Beth O. Jones
*Attorney, Agent, or Firm*—Shlesinger Arkwright & Garvey

[57] ABSTRACT

A valve comprising a cap fitted to the valve casing and in which is formed a fuel circuit terminating inside an injection outlet, and a plug sliding axially inside a seat on the cap between a first position, wherein the plug closes the injection outlet, and a second position, wherein the oulet is open; the plug being activated by an electromagnetic inside the casing, and guiding means being provided for guiding the plug inside the seat on the cap; the fuel circuit comprising a series of holes formed inside the cap and arranged about the aforementioned seat, and an annular chamber formed inside the cap and communicating hydraulically with the aforementioned holes and with the injection outlet; the axis of each of the aforementioned holes forming an angle converging with the axial seat.

11 Claims, 2 Drawing Figures

FUEL METERING VALVE FOR INTERNAL COMBUSTION ENGINE SUPPLY DEVICE

BACKGROUND OF THE INVENTION

The present invention relates to a fuel metering valve forming part of an internal combustion engine supply device.

Devices of the aforementioned type are designed to supply a given quantity of fuel which is mixed with air inside the induction manifold on an internal combustion engine, and substantially comprise means for producing the said mixture and which, via appropriate ducts, are supplied with air, and, via the aforementioned metering valve, are supplied with given quantities of fuel. The said valve substantially comprises an encasement defining a circuit for the fuel fed to the valve by a supply pump, and a plug sliding axially inside the encasement between a first position, wherein it closes the said circuit, and a second position, wherein the said circuit is open. The plug is activated by an electromagnet inside the encasement and is integral with an anchor attracted by the electromagnet core.

The said encasement comprises a cap defining the front part and secured to the remaining part of the encasement itself. The said fuel circuit is formed inside the cap and terminates inside a fuel injection outlet and an axial seat guiding the plug. The said plug presents at least one pair of annular projections, the lateral surface of which consists of cylindrical surface portions and flat surface portions; the said cylindrical surface portions being designed to mate in sliding manner with the corresponding cylindrical surface on the axial seat inside the cap, in such a manner as to guide axial displacement of the plug in relation to the cap; and the said flat surface portions forming, together with the cylindrical surface of the said seat, fuel outlets forming part of the said fuel circuit. The said circuit also comprises a number of radial holes formed in the lateral annular wall of the cap and which, terminating inside the cylindrical surface of the said seat, thus communicate with the outlets formed between the said cylindrical surface of the said seat and the said flat surface portions of the annular projections on the plug.

Valves of the aforementioned type present a number of drawbacks.

Firstly, manufacture involves numerous delicate machining operations. The said holes formed in the lateral wall on the cap, and the axes of which are perpendicular to the cap axis, must be drilled successively, thus greatly increasing the total drilling time required. Furthermore, the fact that the said holes terminate inside the cylindrical surface of the plug sliding seat affects the continuity of the said surface, thus rendering grinding of the same extremely difficult, and preventing the surface diameter from being gauged easily during grinding.

Furthermore, machining the said flat surface portions (forming the fuel outlets) on the annular projections on the plug involves not only turning but also subsequent milling.

Nor is operation of the aforementioned valves wholly satisfactory, owing to fuel flow resistance and the formation of preferential fuel flow through the said outlets, caused by changes in the speed and direction of the fuel as it flows through the said outlets towards the injection outlet.

The poor grinding efficiency of the said cylindrical surfaces mating in sliding manner with the cylindrical surface of the plug sliding seat on the cap results in poor sealing between the plug and the injection outlet on the cap. In fact, owing to the presence of the said flat surface portions on the said annular projections, the said cylindrical surface portions on the said projections may be ground to a fairly wide tolerance, far lower than that obtainable by grinding a continuous cylindrical surface. Finally, on valves of the aforementioned type, the response time to a signal controlling opening and closing of the plug is fairly long, owing to the high degree of inertia on the plug itself.

SUMMARY OF THE INVENTION

The aim of the present invention is to provide a fuel metering valve of the aforementioned type, but involving none of the aforementioned drawbacks, i.e. a valve consisting of parts which may be manufactured easily and cheaply, enabling fuel supply to the injection outlet with little resistance and no change in speed or direction, and which presents a plug providing for perfect sealing, and greatly reduced in size.

With these aims in view, according to the present invention, there is provided a fuel metering valve forming part of an internal combustion engine supply device and comprising a cap fitted to the valve casing and in which is formed a fuel circuit terminating in a fuel injection outlet; and a plug sliding axially inside an axial seat on the said cap between a first position, wherein the said plug closes the said injection outlet, and a second position, wherein the said injection outlet is open; the said plug being activated by an electromagnet inside the said casing, and guide means being provided for guiding the said plug inside the said axial seat on the said cap; characterised by the fact that the said fuel circuit comprises a number of holes formed inside the said cap and arranged about the said axial seat, and an annular chamber formed inside the said cap and communicating hydraulically with the said holes and with the said fuel injection outlet, the axis of each said hole converging with the said axial seat.

DETAILED DESCRIPTION OF THE INVENTION

Figure 1:
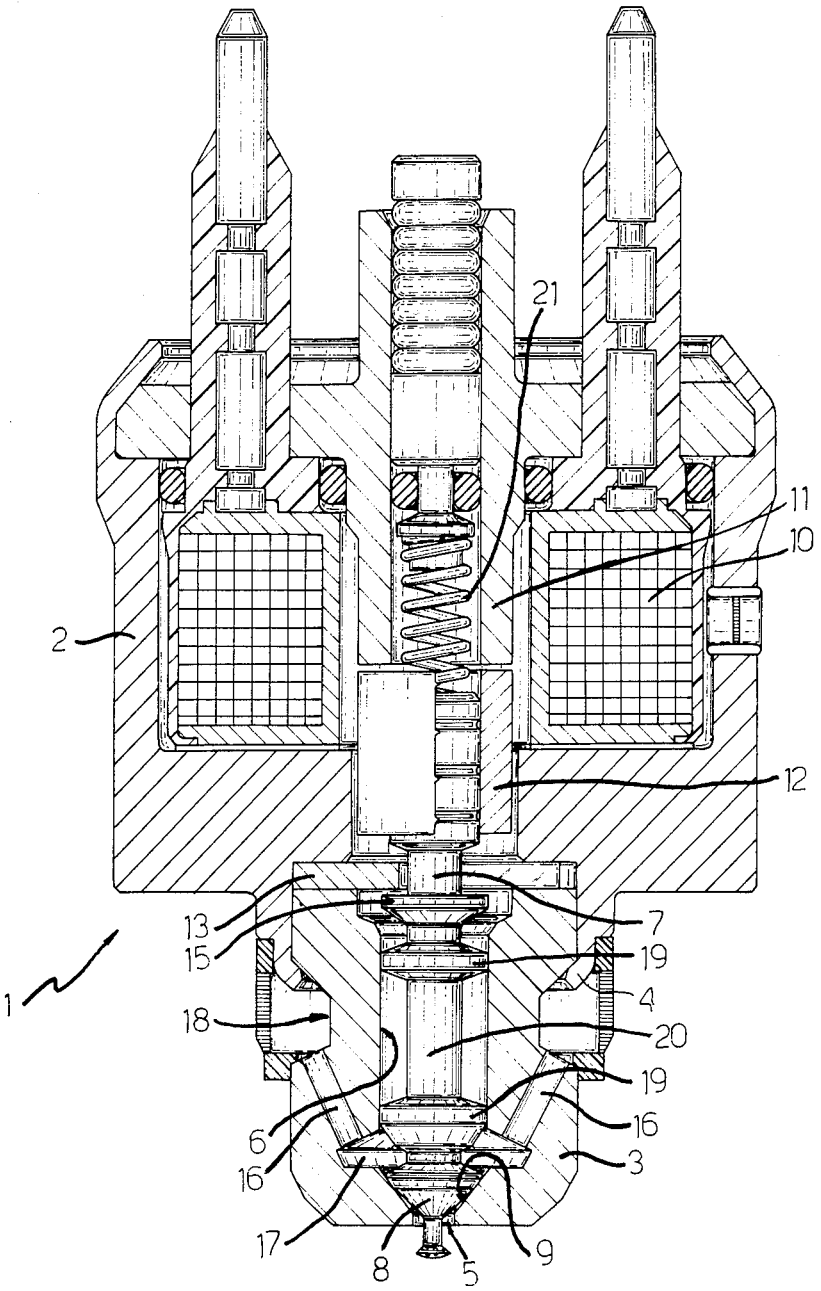
FIG. 1 is a cross-sectional view of the fuel metering valve formed in accordance with the present invention.
Figure 1A:
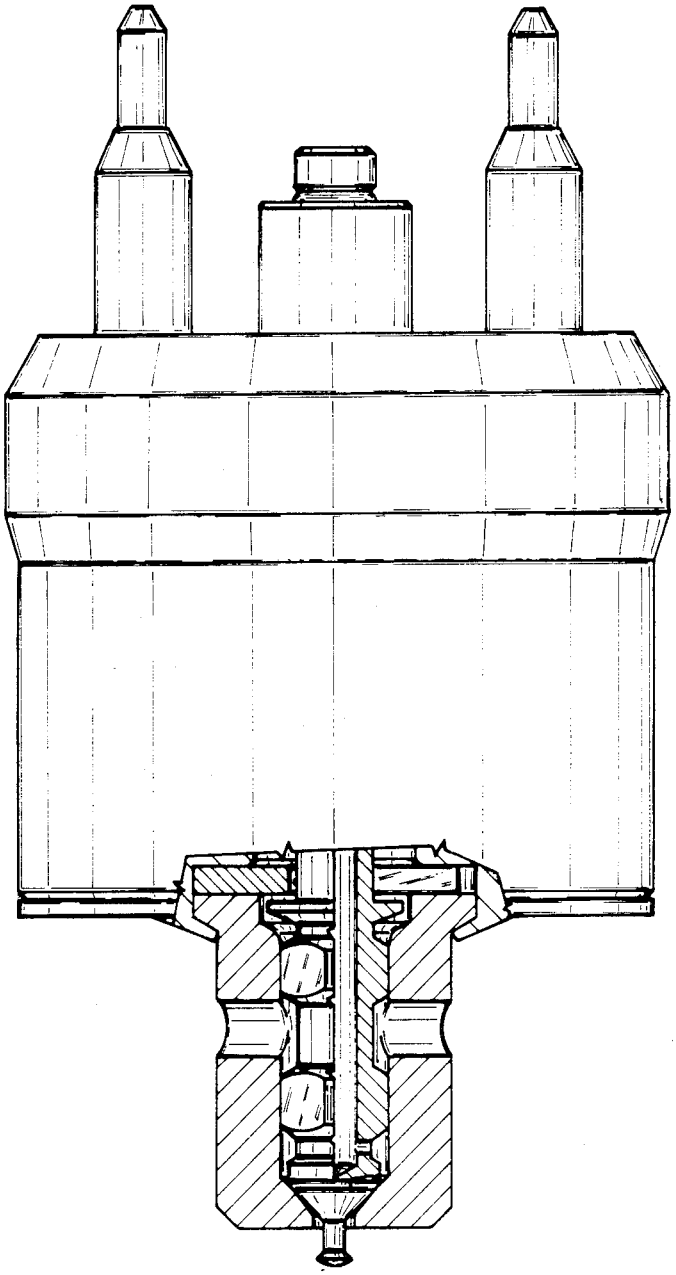
FIG. 1A PRIOR ART
FIG. 1A is a fragmentary cross-sectional view of a prior art fuel metering valve.

The fuel metering valve according to the present invention is designed to fit on an internal combustion engine supply device supplying an air and fuel mixture to the induction manifold on the engine.

The valve according to the present invention presents an encasement indicated as a whole by 1 and comprising a substantially cylindrical casing 2 and a cap 3 defining the front part of the encasement and fitted to the casing in any appropriate manner, e.g. by permanently deforming an annular projection 4 projecting axially from the casing. Inside the said cap 3, there is formed a fuel circuit described in more detail later on and which terminates inside a fuel injection outlet 5. The said cap 3 also presents a substantially cylindrical axial seat 6 housing a plug 7 sliding axially inside the said seat 6 and having an active surface 8 designed to cooperate with a corresponding substantially tapered seat 9 formed inside cap 3 next to injection outlet 5. The said plug 7 is designed to slide inside the said seat 6 between a first position (shown in the drawing), wherein plug 7 closes outlet 5, and a second position, wherein the said outlet 5 is open. Plug 7 is activated by an electromagnet 10 having a core 11 designed to attract an anchor 12 fitted integral with the rear part of plug 7. A stop ring 13, located between cap 3 and casing 2, cooperates with an annular projection 15 on plug 7, for defining displacement of plug 7 in the direction of core 11.

According to the present invention, the said fuel circuit, for supplying fuel to injection outlet 5, comprises a number of holes 16, formed in cap 3 and arranged about axial seat 6 on the same, and an annular chamber 17, also formed in cap 3 and communicating hydraulically with both holes 16 and injection outlet 5. As shown clearly on the attached drawing, the axis of each said hole 16 converges with the axis of axial seat 6, so as to form an angle of less than 90°. The said fuel circuit also comprises an annular groove 18 formed on the outer surface of cap 3 and communicating hydraulically with holes 16. Chamber 17 may be defined by surfaces of any shape, conveniently tapered, as shown in the embodiment on the attached drawing, and presents an outside diameter greater than the diameter of axial seat 6.

The axis of each hole 16 is conveniently oblique in relation to the axis of seat 6, so that the direction of the fuel flowing from each hole 16 into chamber 17 presents a component tangential in relation to chamber 17.

The valve according to the present invention is provided with means for guiding plug 7, said means substantially comprising a pair of cylindrical surfaces 19 mating in sliding manner with the surface of axial seat 6 and each formed on a respective annular projection of plug 7, as shown clearly in the attached drawing.

The said projections project radially from a cylindrical rod 20 consideraly smaller in diameter than the said cylindrical surfaces 19, the said cylindrical surfaces 19 conveniently being over 1.5 times greater in diameter than the said rod 20.

Plug 7 is normally maintained in the closed position shown on the attached drawing, wherein active surface 8 contacts seat 9 on cap 3 by virtue of a helical spring 21 inserted between cap 3 and casing 2.

The fuel metering valve as described operates as follows. In the closed position shown on the attached drawing, fuel flow to injection outlet 5 is cut off by virtue of active surface 8 being held against seat 9 by helical spring 21. For injecting a given amount of fuel, electromagnet 10 is energised for a given length of time, and, subsequent to the pull exerted by core 11 on anchor 12, plug 7 moves away from seat 9 and axially upwards (as seen on the attached drawing) until annular projection 15 comes to rest against stop ring 13, With plug 7 so arranged, the fuel fed by an appropriate supply pump into annular groove 18 flows through holes 16 and chamber 17 and out through outlet 5. As the said fuel circuit presents no sharp changes in section or flow direction, the resulting fuel flow travels smoothly and steadily towards the said outlet 5. In the first portion of the circuit, fuel flows with a constant section, and no change in direction, through the various holes 16 and into chamber 17. Inside the said chamber 17, the various flows from holes 16 form a further steady flow of fuel towards outlet 5, this time substantially annular in shape and, therefore, ideally suited for supplying fuel to the annular channel defined by active surface 8 on plug 7 and corresponding seat 9 on cap 3.

During axial displacement of plug 7, cylindrical surfaces 19 provide for efficient guidance of plug 7 in relation to axial seat 6, by virtue of the extensive contact area between surfaces 19 and the mating surface on seat 6. Should the axes of holes 16 be oblique in relation to the axis of axial seat 6, the direction of the fuel flowing from each said hole 16 presents a component tangential in relation to chamber 17, which provides for efficient mixing of the fuel inside chamber 17, thus improving fuel injection through outlet 5.

The structure of the valve according to the present invention is obviously extremely straightforward, with component parts that may be produced quickly and cheaply by means of normal mechanical machining operations. Such advantages are particularly evident in the construction of cap 3 : holes 16 may be drilled simultaneously, by virtue of each slanting in relation to the axis of seat 6, unlike prior caps with radial holes which must be drilled successively. Furthermore, chamber 17 may be produced easily using the standard spark erosion techniques widely used for producing Diesel engine fuel injection valves. Axial seat 6 housing sliding plug 7 may also be ground to strict tolerances and in far less time, by virtue of the continuous nature of the inner seat surface, which also provides for fast, troublefree gauging of the surface diameter during grinding.

Plug 7 may also be produced cheaply and easily, in that, the annular projections on which cylindrical surfaces 19 are formed need not be milled for obtaining flat surfaces, as on prior valve types.

Furthermore, as already pointed out in the foregoing description, the fuel supply fed to injection outlet 5 along the ducts formed inside cap 3 is perfectly steady with very little flow resistance. As a result of the efficient guiding action performed by cylindrical surfaces 19, active surface 8 on plug 7 provides for perfect sealing with mating seat 9. Finally, as a result of the fairly small size of plug 7, deriving from the small diameter of rod 20, response to the pulses controlling axial displacement of plug 7 is extremely fast.

To those skilled in the art it will be clear that changes may be made to the embodiment described herein without, however, departing from the scope of the present invention.

I claim:

1. A fuel metering valve for internal combustion engines and the like, comprising:

(a) a cap fitted to the valve casing;

(b) said cap having an axial bore extending through at least a portion thereof, said axial bore forming a substantially continuous cylindrical surface in the interior of said cap;

(c) a plug slideably positioned in said axial bore;

(d) said plug having a plurality of projections, said projections having a cylindrical surface operably associated with said axial bore;

(e) an annular groove formed in the outer surface of said cap;

(f) an annular chamber communicating with said axial bore;

(g) a fuel injection outlet communicating with said annular chamber;

(h) a plurality of passageways communicating at a first end with said annular groove and at a second end with said annular chamber, said passageways forming an acute angle with said axial bore;

(i) said first end of said passageways being positioned inwardly from the outer periphery of said cap; and (j) said annular groove being positioned substantially entirely above said first ends of said plurality of passageways and in a plane that is generally perpendicular to the axis of said cap for minimizing the resistance to fuel flow.

2. A cap as in claim 1, wherein:

(a) said annular chamber has an outer diameter substantially equal to the inner diameter of said annular groove and greater than the outer diameter of said axial bore.

3. A cap as in claim 2, wherein:

(a) the outer diameter of said annular chamber is 1.2 times greater than the outer diameter of said axial bore.

4. A cap as in claim 1, wherein:

(a) said annular chamber is substantially conical in shape.

5. A cap as in claim 2, wherein:

(a) said fuel injection outlet includes first and second portions;

(b) said first portion communicates with said annular chamber and forms a seat for said plug; and (c) said first portion having an outer diameter substantially equal to the outer diameter of said axial bore and less than the outer diameter of said annular chamber.

6. A cap as in claim 1, wherein:

(a) said plug includes a substantially cylindrical rod on which said projections are formed; and (b) the outer diameter of said projections is substantially greater than the outer diameter of said cylindrical rod.

7. A fuel injection valve for internal combustion engines and the like, comprising:

(a) a cap fitted to the valve casing;

(b) said cap having an axial bore extending through at least a portion thereof, said axial bore forming a substantially continuous cylindrical surface in the interior of said cap;

(c) a plug slideably positioned in said axial bore;

(d) said plug having a plurality of projections, said projections having a cylindrical surface operably associated with said axial bore;

(e) an annular groove formed in the outer surface of said cap;

(f) an annular chamber communicating with said axial bore;

(g) a fuel injection outlet communicating with said annular chamber;

(h) a plurality of passageways communicating at a first end with said annular groove and at a second end with said annular chamber, said passageways forming an acute angle with said axial bore;

(i) said first end of said passageways being positioned inwardly from the outer periphery of said cap;

(j) said annular groove being positioned substantially entirely above said first ends of said plurality of passageways and in a plane that is generally perpendicular to the axis of said cap for minimizing the resistance to fuel flow; and (k) said annular chamber having an outer diameter substantially equal to the inner diameter of said annular groove and greater than the outer diameter of said axial bore.

8. A fuel meter as in claim 7, wherein:

(a) said annular chamber is substantially conical in shape.

9. A fuel meter as in claim 8, wherein:

(a) said fuel injection outlet includes first and second portions;

(b) said first portion communicates with said annular chamber and forms a seat for said plug; and (c) said first portion having an outer diameter substantially equal to the outer diameter of said axial bore and less than the outer diameter of said annular chamber.

10. A fuel meter as in claim 7, wherein:

(a) said plug includes a substantially cylindrical rod on which said projections are formed; and (b) the outer diameter of said projections is substantially greater than the outer diameter of said cylindrical rod.

11. A fuel meter as in claim 10, wherein:

(a) said outer diameter of said projections is 1.5 times greater than said outer diameter of said cylindrical rod.

* * * * *